US006865839B2

(12) United States Patent
Bantle et al.

(10) Patent No.: US 6,865,839 B2
(45) Date of Patent: Mar. 15, 2005

(54) SAFETY UNITS FOR A HAMMER IN A FIREARM

(75) Inventors: Hans-Peter Bantle, Dunningen (DE); Gerd Spinner, Oberndorf (DE); Helmut Weldle, Oberndorf (DE); Ernst Mauch, Dunningen (DE)

(73) Assignee: Heckler & Koch, GmbH, Orberdorf/Neckar (DE)

( * ) Notice: Subject to any disclaimer, the term of this patent is extended or adjusted under 35 U.S.C. 154(b) by 0 days.

(21) Appl. No.: 10/461,993

(22) Filed: Apr. 18, 2003

(65) Prior Publication Data

US 2003/0213160 A1 Nov. 20, 2003

Related U.S. Application Data

(63) Continuation of application No. 10/163,325, filed on Jun. 5, 2002, now Pat. No. 6,604,312, which is a continuation of application No. PCT/EP00/11888, filed on Nov. 28, 2000.

(30) Foreign Application Priority Data

Dec. 13, 1999 (DE) ..... 199 59 964

(51) Int. Cl.[7] ..... F41A 17/44
(52) U.S. Cl. ..... 42/70.08
(58) Field of Search ..... 42/70.08, 69.03, 42/70.02, 66

(56) References Cited

U.S. PATENT DOCUMENTS

| | | | | | |
|---|---|---|---|---|---|
| 635,705 | A | * | 10/1899 | Wesson | 42/66 |
| 875,469 | A | * | 12/1907 | Tambour | 42/66 |
| 887,784 | A | * | 5/1908 | Fyrberg | 42/66 |
| 961,188 | A | * | 6/1910 | Wesson | 42/66 |
| 982,152 | A | * | 1/1911 | Marble | 42/42.03 |
| 2,372,519 | A | | 3/1945 | Roper | 42/70 |
| 2,468,784 | A | | 5/1949 | Seagraves | 89/195 |
| 2,703,943 | A | * | 3/1955 | Roemer | 42/70.08 |
| 3,415,000 | A | | 12/1968 | Koucky et al. | 42/70 |
| 3,707,796 | A | * | 1/1973 | Bielfeldt | 42/70.05 |

(List continued on next page.)

FOREIGN PATENT DOCUMENTS

| | | | | |
|---|---|---|---|---|
| AT | 133 977 | | 6/1933 | |
| DE | 506 923 | | 9/1930 | |
| EP | 0277922 | A2 * | 10/1988 | ..... F41C/19/00 |
| FR | 571.503 | | 5/1924 | |
| FR | 722.555 | | 3/1932 | |
| FR | 751.009 | | 8/1933 | |
| FR | 802 583 | | 9/1936 | |
| FR | 804 981 | | 11/1936 | |
| GB | 2468 | | of 1914 | |
| GB | 151 196 | | 9/1920 | |

OTHER PUBLICATIONS

International Search Report in PCT/EP00/11888 dated Feb. 27, 2001.
International Preliminary Examination Report in PCT/EP00/11888 dated Feb. 11, 2002 (German and English versions, each including annexes).
International Search Report in PCT/EP01/12253 dated Feb. 15, 2002.

*Primary Examiner*—Michael Carone
*Assistant Examiner*—Troy Chambers
(74) *Attorney, Agent, or Firm*—Hanley, Flight & Zimmerman, LLC

(57) ABSTRACT

Safety devices for use with a handheld firearm are disclosed. The safety devices include a lever that can be pivoted into the travel path of the hammer of the firearm to preclude the hammer from striking a firing pin. In an example, the lever is connected to the trigger such that the safety device is released when the trigger is pulled. In another example, the lever protrudes into the magazine shaft of the firearm such that the safety device is only released when a magazine is inserted into the shaft.

11 Claims, 4 Drawing Sheets

U.S. PATENT DOCUMENTS

| | | | | | |
|---|---|---|---|---|---|
| 3,715,826 | A | | 2/1973 | Seifried | 42/70 |
| 3,748,771 | A | * | 7/1973 | Piscetta | 42/66 |
| 3,838,533 | A | * | 10/1974 | Ruger | 42/70.08 |
| 3,962,809 | A | | 6/1976 | Lee | 42/66 |
| 4,031,648 | A | | 6/1977 | Thomas | 42/70 A |
| 4,352,317 | A | | 10/1982 | Wilhelm | 89/154 |
| 4,399,628 | A | | 8/1983 | Franchi et al. | 42/42 R |
| 5,225,612 | A | | 7/1993 | Bernkrant | 42/70.02 |
| 5,355,768 | A | | 10/1994 | Felk | 89/147 |
| 5,438,784 | A | | 8/1995 | Lenkarski et al. | 42/70.02 |
| 5,560,132 | A | | 10/1996 | Merlino | 42/66 |
| 5,625,971 | A | * | 5/1997 | Tuma et al. | 42/70.08 |
| 5,915,935 | A | | 6/1999 | Weldle et al. | 42/69.03 |
| 6,253,479 | B1 | | 7/2001 | Fuchs et al. | 42/70.02 |
| 6,604,312 | B2 | * | 8/2003 | Bantle et al. | 42/70.02 |

* cited by examiner

SAFETY UNITS FOR A HAMMER IN A FIREARM

RELATED APPLICATION

This patent is a continuation of U.S. patent application Ser. No. 10/163,325, filed Jun. 5, 2002, now U.S. Pat. No. 6,604,312 which is a continuation of PCT/EP00/11888, filed Nov. 28, 2000.

FIELD OF THE DISCLOSURE

This disclosure relates generally to firearms and, more particularly, to safety units for a hammer in a self-loading firearm.

BACKGROUND

The hammer of a typical hand-held firearm is secured in a cocked position through engagement of the hammer with a component such as the bar or trigger. The hammer is generally held in the cocked position via an engaging projection that is formed in the lower portion of the hammer. If the weapon should accidentally fall to the ground, then forces act on the component securing the hammer. These forces can lift the securing component (typically, against the force of a retaining spring), out of the projection so that the hammer is released and a shot is then triggered unintentionally.

Many proposals have been made in order to make trigger and safety devices more effective and secure. (See, for example, U.S. Pat. No. 3,962,809.) Many of these proposals are entirely effective, but are also complicated. For example, it is known to block or lift the striking spring out of the motion path of the hammer if the trigger is not pulled. However, these known devices have sliding parts which, in the case of dirty, unlubricated, or rusted weapons, are sluggish, and therefore make the pulling of the trigger to fire a shot difficult.

Furthermore, many safety parts are stressed to the point of bending, and can even possibly break. For example, even the engaging projection of the hammer could break off. If hammers of plastic are used instead of steel hammers, as was recently normally the case, then access to the centuries of materials expertise available to steel hammers is lost and a very improbable event in the context of steel hammers (namely, hammer part breakage), must be taken into consideration.

A swiveling lever has been shown in U.S. Pat. No. 5,225,612. The lever of the '612 Patent serves as a magazine safety unit and can be stressed in the safety position by the guide bar of the striking spring if the hammer of a self-loading pistol is clamped without a magazine having been inserted. However, this swiveling lever is not stressed in the direction of its transverse axis, but is instead swiveled at an angle to this axis against a stationary construction on which it is supported in a stable manner.

A safety device in which an eccentric shaft projects out, upon rotation, over the rear end of the firing pin and, thus, receives the striking hammer, is already known. Fine particulate matter that sprays through the weapon can, however, cause a particle to be caught behind the firing pin. In such circumstances, the particle passes the impact of the hammer along to the firing pin through the eccentric shaft.

U.S. Pat. No. 4,352,317 is also relevant prior art as explained below.

DESCRIPTION OF THE PREFERRED EXAMPLES

Figure 4:
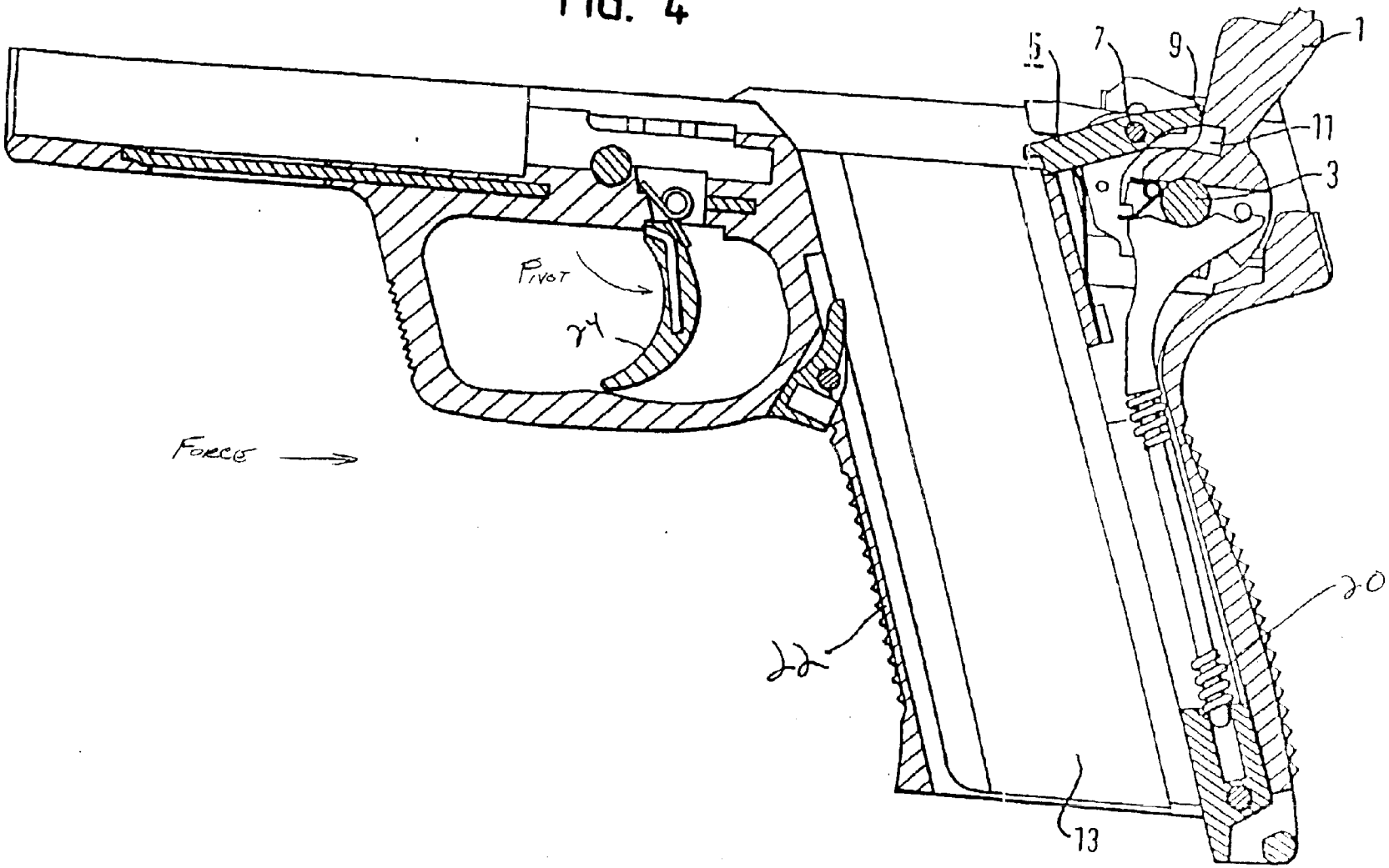
FIG. 4 is a longitudinal sectional view through a firearm grip, with the magazine safety unit of FIG. 3 shown in the safety position.

A hammer (1), which is swivelable around an axis (3), is depicted in all of the figures. The swiveling movement is carried out in the clockwise direction, against the effect of a striking spring (20), which is shown in FIG. 4. Upon release of the energy in the striking spring (20), the hammer (1) moves in a counterclockwise direction toward a firing pin (10).

The hammer (1) has, on its front surface facing in the direction of striking (i.e., the direction of the firing pin (10)), a contact point (9). Directly below the contact point (9), an elongated recess (11) is formed. In relation to the axis (3) of the hammer (1), the recess (11) extends in approximately the circumferential direction.

Figure 1:
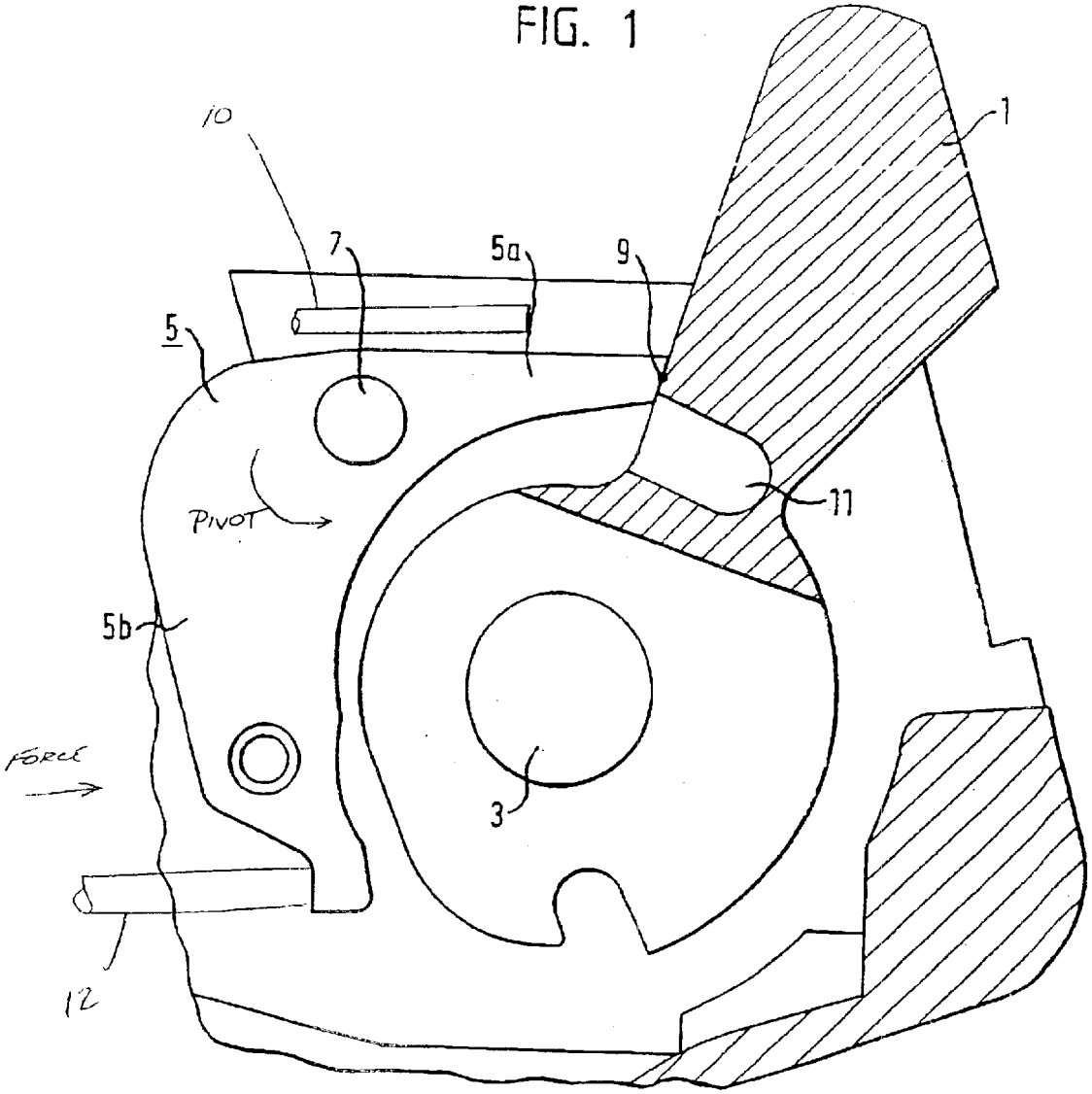
FIG. 1 is a partial longitudinal sectional view through a self-loading firearm with a hammer and a swiveling lever in the safety position.

The safety unit includes a swiveling lever (5) which is mounted for pivoting about a lateral axis (7). The lateral axis (7) is located parallel to the axis (3) of the hammer (1). The center of the axis (3) is placed in front of the contact point (9) as shown in FIG. 1. The lateral axis (7) is positioned in front of, and above, the axis (3) of the hammer (1), in relation to the direction of shooting and the normal cocked position of the weapon. In the ideal case, the lateral axis (7) lies on a tangent of a circle drawn around the middle point of the axis (3) of the hammer (1) and passing through the contact point (9) if the contact point occupies the position shown in FIG. 1. Slight deviations of the lateral axis (7) from this ideal position are, of course, permissible.

In the illustrated example, the swiveling lever (5) is a two-flank lever. One of the flanks **(5*a*) is directed toward the hammer (1). The second flank (5*b*)** is downwardly directed.

Figure 2:
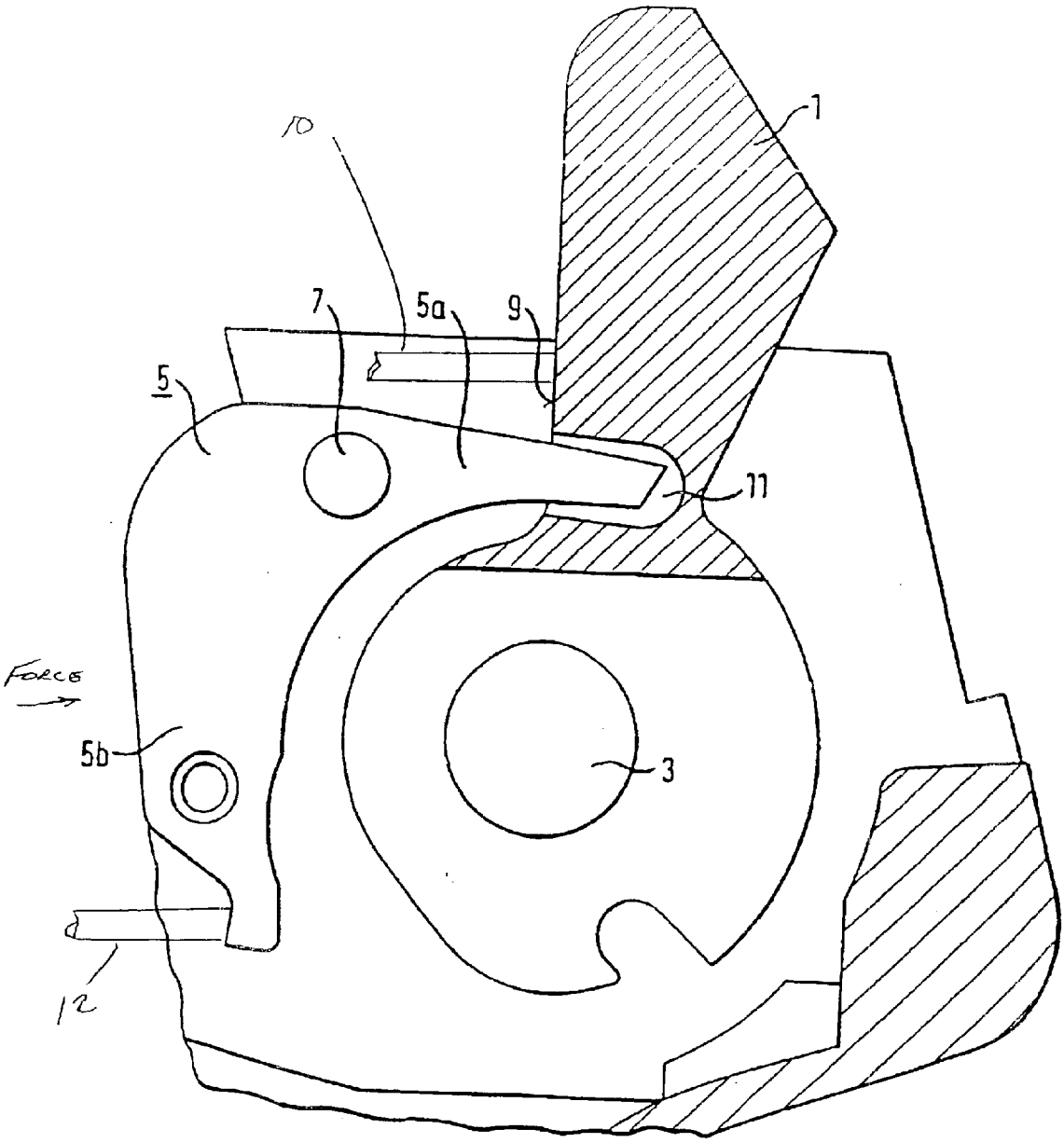
FIG. 2 is a view similar to FIG. 1, but with the swiveling lever in the firing position and with the hammer pulled back.

The swiveling lever (5) can occupy two positions, namely, a first position (for example, the position shown in FIGS. 1, 3 and 4 referred to herein as the safety position), and a second position (for example, the position shown in FIG. 2 referred to herein as the firing position). To reach the safety position, the swiveling lever (5) is swiveled in a counterclockwise direction into an end position. The end of the flank **(5*a*) engages the hammer (1) precisely at the contact point (9) if the hammer (1) is pulled back. The hammer (1) is, therefore, supported by the flank (5*a*). As a result of this engagement, the firing of a shot is effectively impeded. Specifically, in the safety position, the hammer (1) cannot reach its forwardmost position and, thus, cannot strike the firing pin. The spring force acting on the hammer (1) is guided, by way of this flank (5*a*) and the lateral axis (7), into the pistol grip (22) (shown in FIG. 4**).

On the other hand, to reach the firing position (see FIG. 2), the swiveling lever (5) is swiveled in a clockwise direction, so that the flank **(5*a*) penetrates into the recess (11). The recess (11) and flank (5*a*) are sized and positioned in such a manner that the movement of the hammer (1) is not impeded by the swiveling lever (5) until the flank (5*a*) is located in the recess (11)**.

In the examples of FIGS. 1 and 2, the free, downwardly-directed flank **(5*b*) of the swiveling lever (5) is connected with the trigger such that pulling the trigger moves the swiveling lever (5) out from the safety position of FIG. 1 and into the firing position of FIG. 2. In other words, the trigger (24) (see FIG. 4) is operatively connected to the lever (5) (e.g., through a bar (12**)) such that pulling the trigger pivots the lever clockwise.

In the example of FIGS. 1 and 2, the swiveling lever (5) slightly resembles the trigger (24) in shape, and is also installed in the same orientation as the trigger (24). If, as a result of the dropping of the weapon, inertial forces act on the trigger (24) and influence it toward firing (i.e., tend to pivot the trigger backward in FIG. 4), the same inertial forces also act on the swiveling lever (5) (i.e., the forces tend to move the lever (5) in a counterclockwise direction). Thus, the inertial forces tend to move the lever (5) into the safety position, or else to hold it in the safety position. Consequently, the effect of these forces on the lever (5) is directly opposite to their effect on the trigger (24). As a result, the firing of a shot is not brought about by dropping the weapon.

Figure 3:
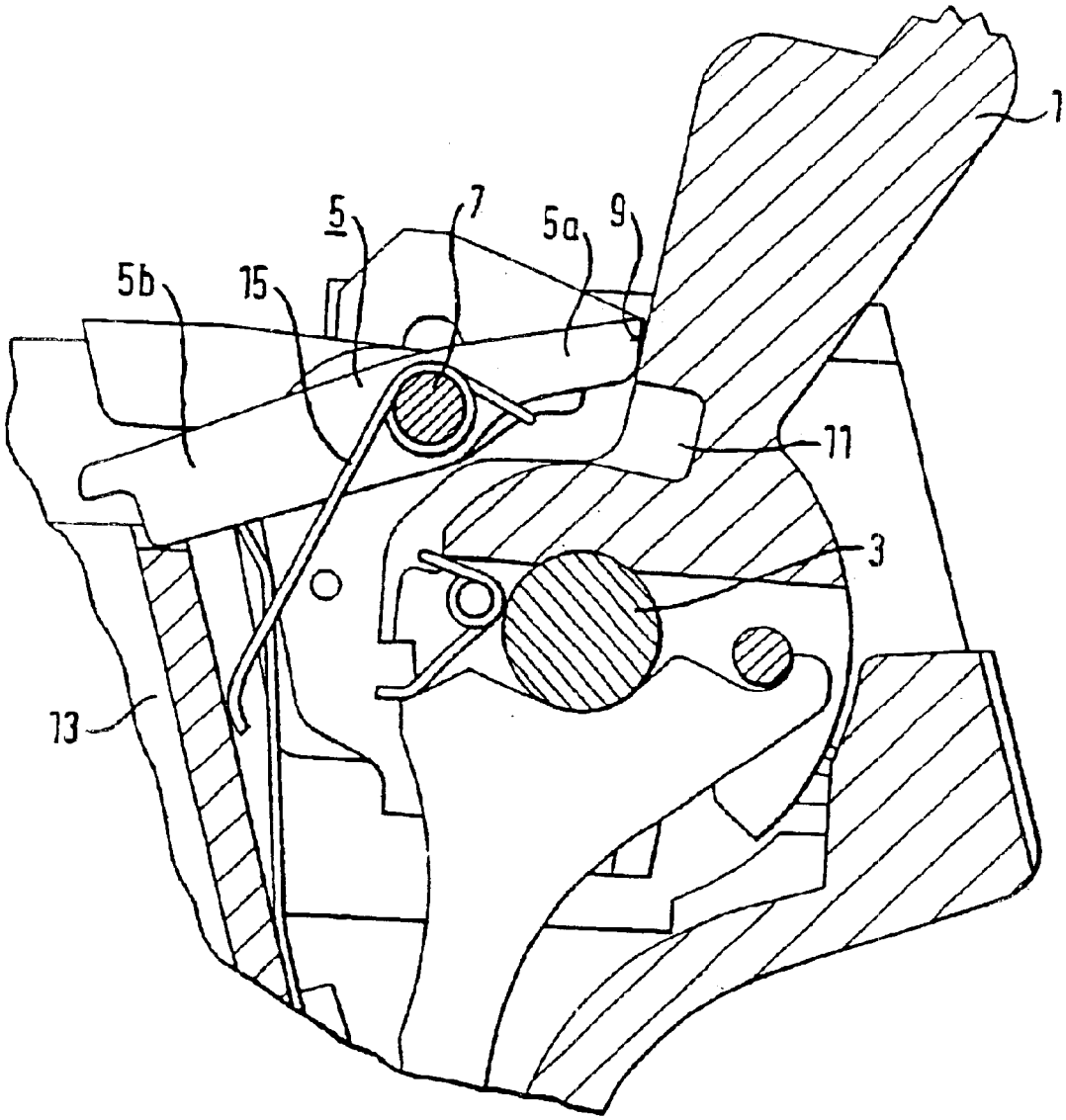
FIG. 3 is a partial, longitudinal sectional view through a firearm with a magazine safety unit in the safety position.

An example firearm grip is shown in FIG. 4 with an empty magazine shaft (13) (i.e., with the magazine removed). As shown in FIG. 3, in this example the shape of the lever (5) is different. Further, the swiveling lever (5) is moved, by a wire spring (15), into such a position that its forward flank (5*b*) points generally away from the hammer (1) and penetrates into the magazine shaft (13) if no magazine is present. Its rearward flank (5*a*), is located outside the recess (11) in engagement with the contact point (9) of the hammer (1). The swiveling lever (5) is, thus, located in a safety position in FIGS. 3 and 4. If a magazine is now inserted into the magazine shaft (13), it pushes the lever (5) upward such that the swiveling lever (5) swivels in the clockwise direction into the firing position wherein the rearward flank (5*a*) is received in the recess (11). In this manner, a simple but extremely effective magazine safety unit is provided. The magazine safety unit can be completely independent of the other triggering or other safety devices.

From the foregoing, persons of ordinary skill in the art will appreciate that it is also possible to combine this magazine safety unit with the previously described dropping safety unit of FIGS. 1–2. In such a case, either two swiveling levers (5) are provided, or the flank (5*b*) that is oriented away from the hammer (1) is formed in such a manner that it can enter into engagement with both the triggering device and the magazine.

From the foregoing, persons of ordinary skill in the art will further appreciate that a smooth-operating safety device which avoids accidental triggering of a shot, even upon an unintended dropping of the weapon, and which also has a very high security against breakage has been disclosed. To this end, the swiveling lever (5) is rotatably supported on a lateral axis (7) near the motion path of the hammer (1) such that the free end (5*a*) of the lever (5) can be brought into the impact path of the hammer (1). Thus, the contact point (9) of the hammer (1) strikes on the free end (5*a*) of the swiveling lever (5) rather than reaching the firing pin. Simply stated, the swiveling lever (5) prevents the hammer (1) from striking the firing pin or on the firing cap of a cartridge. The lateral axis (7) is positioned approximately on an extension of the motion path of the hammer (1).

The swiveling lever (5) is independent of all other parts of the trigger mechanism. The separate swiveling lever (5) does not engage in any marginal recess of the firing pin, but instead interposes itself between the hammer (1) and the firing pin. The contact point (9) on the hammer (1) is selected in such a manner to avoid any damage to the hammer (1) which might otherwise occur from the impact on the lever (5).

When necessary, the swiveling lever (5) is swiveled into the motion path of the contact point (9). The lever (5) only carries out a swiveling movement around an axis (7), not a translational movement. The movement-impeding influence of dirt and rust is, thus, reduced to a minimum level.

When it is struck by the hammer (1), the lever (5) is only stressed in its longitudinal direction, not in the transverse direction. Consequently, breaking of the swiveling lever (5) due to this impact is excluded as a practical matter.

The lateral axis (7) supporting the lever (5) only experiences shear stress. Thus, the danger of breaking this axis/pin (7) can be minimized or at least reduced by selecting a sufficiently thick axis/pin (7).

Through a suitable configuration and formation of the swiveling lever (5), it is possible that the hammer (1) can be repeatedly cocked and released via the trigger (24), even if the swiveling lever (5) is located in its safety position. As a result, it is possible to practice with the secured weapon without the danger ever arising that a bullet possibly forgotten in the barrel will be fired.

If the safety device is connected with the trigger (24) such that the lever (5) is only swiveled out of the motion path of the contact point (9) if the trigger is pulled as shown in FIGS. 1–2, then the safety device replaces the so-called catching stop (first catch, safety stop). If the hammer (1) is released, it does not fall into the catching stop but, instead, onto the swiveling lever (5) which, in contrast to the catching stop, cannot break off.

In the disclosed safety devices, the hammer (1) can be blocked in any position desired. Thus, an enlarged distance is provided between the firing pin and the lever (5) as compared to the prior art. This enlarged distance ensures a particle behind the firing pin will not be able to transmit the impact of the hammer from the lever (5) to the firing pin to, thus, fire a shot.

As explained above, in the disclosed safety devices, a recess (11) into which the swiveling lever (5) penetrates upon the unsecured striking of the hammer (1) is formed closely adjacent to the contact point (9). This concept is known from U.S. Pat. No. 4,352,317. The above statements concerning the catching stop primarily concern a hammer. The transverse axis (7), around which the swiveling lever (5) can be swiveled, proceeds in parallel to the axis (3) of the hammer (1) and lies approximately on a tangent to the circular path of the contact point (9) proceeding from the point that the contact point (9) occupies if it strikes on the swiveling lever (5). This configuration is simple in constructional terms, but is extremely stable and reliable.

In the example of FIGS. 1–2, the swiveling lever (5) is designed in a two-flanked manner. The two flanks (5*a*), (5*b*) correspond to the trigger, both in accordance with their mutual mass ratio and in accordance with their orientation. The trigger (24) is connected with the swiveling lever (5), preferably by way of the free end of the flank (5*a*). If the weapon drops to the ground and is thereby exposed to inertial forces that tend to swivel the trigger (24), then these same inertial forces also tend to swivel the swiveling lever (5). Thus, these inertial forces tend to move the swiveling lever (5) toward the safety position or to hold the lever (5) in the safety position. In other words, the consequence of the above-described dropping of the weapon is that the inertial forces do, to be sure, tend to pull on the trigger (24), but the same mass forces simultaneously tend to hold the swiveling lever (5) in the safety position. Consequently, the inertial forces acting on the trigger (24) and the swiveling lever (5) cancel one another out, at least to the extent that the trigger spring (see FIG. 4) reliably holds the trigger (24) in its position.

The additional flank (5*a*) of the lever (5) can, however, be pressed by means of a spring (15) into the empty magazine shaft (13) of a multi-shot weapon. In this position, the swiveling lever (5) is located in a safety position (see FIG. 3). If a magazine is now inserted into the magazine shaft (13), then the magazine presses the flank (5*a*) to the side against the spring force to thereby swivel the swiveling lever (5) into the firing position. Thus, a simple but reliable magazine safety unit is created.

Both of the safety devices described (the dropping safety unit of FIGS. 1–2 and the magazine safety unit of FIGS. 3–4) can also be jointly realized in one weapon and, specifically so, with two swiveling levers, or even with only one. In the latter case, the swiveling lever can only be swiveled into the firing position if the magazine is present and the trigger is pulled at the same time.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. For use with a firearm having a firing pin, a trigger, a trigger spring biasing the trigger toward a forward position, a magazine shaft and a removable magazine, a safety unit comprising:

a hammer defining a recess and being mounted for pivoting movement about an axis, the hammer including a contact point positioned adjacent the recess, wherein the contact point strikes the firing pin when the hammer moves from a cocked position to a fired position, the contact point follows a motion path when the hammer moves from the cocked position to the fired position; and a swiveling lever mounted for rotation about a lateral axis between a safety position and a firing position such that a first end of the lever is received in the recess of the hammer if the lever is in the firing position when the hammer moves from the cocked position toward the fired position and the contact point of the hammer engages the first end of the lever if the lever is in the safety position when the hammer moves from the cocked position toward the fired position, the lateral axis being disposed parallel to the axis of the hammer and approximately on a tangent to the motion path of the contact point proceeding from a point occupied by the contact point when the hammer engages the swiveling lever with the swiveling lever in the safety position, the swiveling lever moving from the firing position to the safety position in response to an acceleration of the firearm.

2. A safety unit as defined in claim 1 wherein the swiveling lever has a first flank and a second flank located on opposite sides of the lateral axis.

3. A safety unit as defined in claim 1 wherein the lever is operatively connected with the trigger such that pulling the trigger moves the swiveling lever from the safety position to the firing position.

4. A safety unit as defined in claim 1 wherein forces acting upon the trigger which are insufficient to overcome the biasing of the trigger spring tend to move the lever toward the safety position.

5. A safety unit as defined in claim 2, further comprising a spring biasing the lever into the safety position, wherein the first flank moves under the influence of the spring into the magazine shaft when the removable magazine is not present, and the first flank is moved out of the magazine shaft upon insertion of the removable magazine into the magazine shaft.

6. A safety unit as defined in claim 5 wherein the first end is located on the second flank.

7. For use in a firearm, a safety unit comprising:

a hammer defining a recess and mounted for movement between a cocked position and a fired position;

a lever having a mass, the lever defining an end and mounted for movement between a safety position and a firing position, wherein, when the lever is in the safety position, the hammer strikes the end of the lever if it moves from the cocked position toward the fired position and, thus, cannot reach the fired position from the cocked position, and when the lever is in the firing position, the end enters the recess when the hammer moves from the cocked position toward the firing position; and a trigger having a mass, the trigger being operatively coupled to the lever and the hammer, such that pulling the trigger moves the lever into the firing position and releases the hammer for movement from the cocked position to the fired position, wherein the mass of the lever and the mass of the trigger are substantially the same.

8. A safety unit as defined in claim 7 wherein the trigger and the lever are mounted to pivot in a first angular direction in response to an external force which is less than a pulling force associated with the trigger, and the lever moves toward the safety position when the lever moves in the first angular direction.

9. For use in a firearm, a safety unit comprising:

a hammer defining a recess and mounted for movement between a cocked position and a fired position;

a lever having a mass, the lever defining an end and mounted for movement between a safety position and a firing position, wherein, when the lever is in the safety position, the hammer strikes the end of the lever if the hammer moves from the cocked position toward the fired position and, thus, cannot reach the fired position from the cocked position, and when the lever is in the firing position, the end enters the recess when the hammer moves from the cocked position toward the firing position;

a trigger having a mass substantially the same as the mass of the lever, the trigger being operative to release the hammer from the cocked position to the fired position, wherein the trigger is coupled to the lever and wherein pulling the trigger moves the lever into the firing position.

10. A safety unit as defined in claim 1 wherein the trigger experiences a first mass force in response to the acceleration of the firearm and the swiveling lever experiences a second mass force in response to the acceleration of the firearm and wherein the first mass force is substantially similar in magnitude to the second mass force.

11. For use with a firearm having a firing pin, a safety unit comprising:

a hammer defining a recess and being mounted for pivoting movement about an axis, the hammer including a contact point positioned adjacent the recess, wherein the contact point strikes the firing pin when the hammer moves from a cocked position to a fired position, the contact point follows a motion path when the hammer moves from the cocked position to the fired position;

a trigger having a mass, the trigger, when pulled, releasing the hammer from the cocked position, and a swiveling lever having a mass substantially the same as the mass of the trigger, the lever being mounted for rotation about a lateral axis between a safety position and a firing position such that a first end of the lever is received in the recess of the hammer if the lever is in the firing position when the hammer moves from the cocked position toward the fired position and the contact point of the hammer engages the first end of the lever if the lever is in the safety position when the hammer moves from the cocked position toward the fired position, the lateral axis being disposed parallel to the axis of the hammer and approximately on a tangent to the motion path of the contact point proceeding from a point occupied by the contact point when the hammer engages the swiveling lever with the swiveling lever in the safety position.

* * * * *